US009465325B2

(12) United States Patent
Asano

(10) Patent No.: US 9,465,325 B2
(45) Date of Patent: Oct. 11, 2016

(54) IMAGE FORMING APPARATUS, IMAGE FORMING APPARATUS CONTROL METHOD, AND RECORDING MEDIUM STORING IMAGE FORMING APPARATUS CONTROL PROGRAM

(71) Applicant: Yoshihiro Asano, Kanagawa (JP)

(72) Inventor: Yoshihiro Asano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/248,021

(22) Filed: Apr. 8, 2014

(65) Prior Publication Data

US 2014/0314429 A1 Oct. 23, 2014

(30) Foreign Application Priority Data

Apr. 17, 2013 (JP) ..... 2013-086574

(51) Int. Cl.
*G03G 21/00* (2006.01)
*G03G 15/00* (2006.01)
*G03G 15/16* (2006.01)

(52) U.S. Cl.
CPC ..... *G03G 15/161* (2013.01); *G03G 15/167* (2013.01)

(58) Field of Classification Search
CPC .. G03G 15/161; G03G 15/167; G03G 15/00; G03G 21/00; G03G 21/10
USPC ..... 399/21, 34, 71, 121
See application file for complete search history.

(56) References Cited

U.S. PATENT DOCUMENTS 5,860,043 A * 1/1999 Ahn ..... G03G 15/167 399/111
5,943,524 A * 8/1999 Eom ..... G03G 15/1605 399/18
7,831,185 B2 * 11/2010 Masubuchi ..... G03G 15/0131 399/302
2002/0041771 A1 * 4/2002 Katayanagi ..... G03G 15/161 399/66
2007/0048032 A1 * 3/2007 Sakai ..... G03G 15/234 399/309

(Continued)

FOREIGN PATENT DOCUMENTS

JP 59118486 A * 7/1984 ..... G03G 15/00
JP 08062905 A * 3/1996 ..... G03G 21/10

(Continued)

*Primary Examiner* — Nguyen Ha
(74) *Attorney, Agent, or Firm* — Duft Bornsen & Fettig LLP

(57) ABSTRACT

An image forming apparatus and a method of controlling an image forming apparatus, and a non-transitory recording medium storing a program for controlling an image forming apparatus are provided. Each of the image forming apparatus, the method, and the program obtains and stores image identifiers, obtains and stores a passing image identifier for identifying an image to be output to a recording medium to which failure has occurred, transfers a developer image to the recording medium, holds the developer image, presses the recording medium against the holding member, generates and obtains a trigger signal used for determining timing at which a developer image reaches a transfer unit, detects an error in conveyance of the recording medium, and creates a gap between a holding member and a pressing member disposed opposite the holding member when an error is detected in conveyance of the recording medium.

15 Claims, 10 Drawing Sheets

(56) References Cited

U.S. PATENT DOCUMENTS

| | | | | |
|---|---|---|---|---|
| 2007/0242965 | A1* | 10/2007 | Akamatsu | G03G 15/0131 399/49 |
| 2009/0161140 | A1* | 6/2009 | Devries | 358/1.14 |
| 2010/0034565 | A1 | 2/2010 | Ashikawa et al. | |
| 2010/0142985 | A1* | 6/2010 | Minbe | G03G 15/2032 399/66 |
| 2011/0158690 | A1* | 6/2011 | Mimbu et al. | 399/121 |
| 2012/0008991 | A1 | 1/2012 | Shimizu | |
| 2012/0076554 | A1* | 3/2012 | Kaseda | G03G 15/161 399/316 |
| 2012/0104689 | A1* | 5/2012 | Tamada et al. | 271/220 |
| 2012/0189358 | A1* | 7/2012 | Echigo | 399/302 |
| 2013/0121715 | A1 | 5/2013 | Ashikawa et al. | |
| 2014/0072340 | A1* | 3/2014 | Kato | G03G 15/1605 399/121 |

FOREIGN PATENT DOCUMENTS

| | | | | | |
|---|---|---|---|---|---|
| JP | 09138533 | A | * | 5/1997 | G03G 15/00 |
| JP | 2003241480 | A | * | 8/2003 | G03G 21/00 |
| JP | 2004252061 | A | * | 9/2004 | G03G 15/16 |
| JP | 2006178042 | A | * | 7/2006 | G03G 21/00 |
| JP | 2007121384 | A | * | 5/2007 | G03G 21/00 |
| JP | 2012-018369 | | | 1/2012 | |
| JP | 2012163684 | A | * | 8/2012 | G03G 15/00 |

* cited by examiner

| IMAGE ID | ADJUSTMENT PATTERN | SHOCK JITTER CANCELLATION | LEADING END TIMING | TRAILING END TIMING |
|---|---|---|---|---|
| img001 | PRESENT | UNNECESSARY | XXX SECONDS | XXX SECONDS |
| img002 | ABSENT | UNNECESSARY | XXX SECONDS | XXX SECONDS |
| img003 | ABSENT | NECESSARY | XXX SECONDS | XXX SECONDS |
| img004 | PRESENT | UNNECESSARY | XXX SECONDS | XXX SECONDS |

| PASSING IMAGE ID |
| --- |
| img003 |
| – |
| – |
| – |

IMAGE FORMING APPARATUS, IMAGE FORMING APPARATUS CONTROL METHOD, AND RECORDING MEDIUM STORING IMAGE FORMING APPARATUS CONTROL PROGRAM

CROSS-REFERENCE TO RELATED APPLICATION

This patent application is based on and claims priority pursuant to 35 U.S.C. §119(a) to Japanese Patent Application No. 2013-086574, filed on Apr. 17, 2013, in the Japan Patent Office, the entire disclosure of which is hereby incorporated by reference herein.

BACKGROUND

1. Technical Field

Example embodiments generally relate to an image forming apparatus, a method of controlling an image forming apparatus, and a non-transitory recording medium storing a program for controlling an image forming apparatus.

2. Background Art

In recent years, there has been a trend toward converting information into electronic form. As a result, image processing apparatuses such as printers and fax machines that are used to output the digitized information, and image processing apparatuses such as scanners that are used to digitize documents, have become indispensable.

Such image processing apparatuses are usually provided with an imaging capability, an image forming capability, a communication capability, or the like, and are configured as an MFP (multifunction peripheral) that can be used as a printer, facsimile, scanner, or copier.

As a model of the image forming and outputting processes of digitized information, image forming apparatuses that adopt an electrophotographic method are used for developing with developer an electrostatic latent image obtained by exposing a photoreceptor and for transferring the developed image to a recording medium (typically paper). Some electrophotographic image forming apparatuses use a separating mechanism for separating an image holding member that holds a developed developer image from a pressing member that presses the paper against the image holding member at a transfer unit that transfers the developed image on paper.

It sometimes happens that paper gets jammed and is not conveyed to the transfer unit, leaving the toner image to be formed directly on the pressing member, which is undesirable.

SUMMARY

Disclosed embodiments provide an image forming apparatus, a method of controlling an image forming apparatus, and a recording medium storing a program for controlling an image forming apparatus. Each of the image forming apparatus, the method of controlling an image forming apparatus, and the program for controlling an image forming apparatus obtains and stores image identifiers for identifying images to be formed and output, in the order of output, obtains and stores a passing image identifier for identifying an image to be output to a recording medium to which failure has occurred among the images to be formed and output, transfers a developer image to the recording medium, the developer image being an image to be formed and output developed by developer, holds the developer image, presses the recording medium against a holding member, generates a trigger signal used for determining timing at which a developer image reaches a transfer unit, obtains the trigger signal, compares the image identifier identifying the developer image reaching the transfer unit with the stored passing image identifier to detect an error in conveyance of the recording medium to which the developer image reaching the transfer unit is to be transferred, and creates a gap, at a timing specified by the trigger signal, between the holding member and a pressing member when an error is detected in conveyance of the recording medium to which the developer image reaching the transfer unit is to be transferred.

BRIEF DESCRIPTION OF THE SEVERAL VIEWS OF THE DRAWINGS

A more complete appreciation of exemplary embodiments and the many attendant advantages thereof will be readily obtained as the same becomes better understood by reference to the following detailed description when considered in connection with the accompanying drawings.

Figure 1:
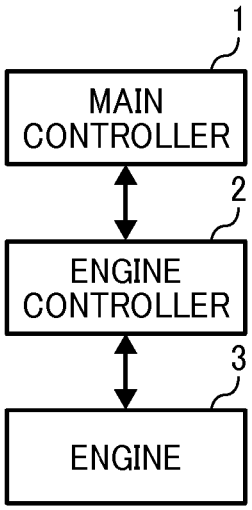
FIG. 1 is a block diagram schematically illustrating a part of a general configuration of an image forming apparatus according to an example embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that have the same structure, operate in a similar manner, and achieve a similar result.

In the following description, illustrative embodiments will be described with reference to acts and symbolic representations of operations (e.g., in the form of flowcharts) that may be implemented as program modules or functional processes including routines, programs, objects, components, data structures, etc., that perform particular tasks or implement particular abstract data types and may be implemented using existing hardware at existing network elements or control nodes. Such existing hardware may include one or more Central Processing Units (CPUs), digital signal processors (DSPs), application-specific-integrated-circuits (ASICs), field programmable gate arrays (FPGAs) computers or the like. These terms in general may be collectively referred to as processors.

Unless specifically stated otherwise, or as is apparent from the discussion, terms such as "processing" or "computing" or "calculating" or "determining" or "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

Example embodiments of the present invention are described below in detail with reference to the drawings. In these example embodiments of the present invention, when an image forming apparatus runs out of paper or paper jam occurs, an image is passed by using a shock jitter canceling mechanism provided for the image forming apparatus.

FIG. 1 is a block diagram schematically illustrating a part of a general configuration of an image forming apparatus according to an example embodiment of the present invention. As illustrated in FIG. 1, the image forming apparatus according to the present example embodiment includes a main controller 1, an engine controller 2, and an engine 3.

The main controller 1 controls the overall operation of the image forming apparatus. For example, the main controller 1 sends and receives data through the network, processes the received print job, and performs image processing. Moreover, the main controller 1 controls a control panel that allows a user to operate the image forming apparatus, and a display that allows a user to obtain data from the image forming apparatus through displaying such data.

The engine controller 2 controls the engine 3 that actually performs image forming and outputting processes, and more particularly, controls elements of the engine 3. The engine 3 is a mechanism that actually forms and outputs images, and includes elements such as a conveyance mechanism that conveys paper and an image formation mechanism that forms an image on paper.

Figure 2:
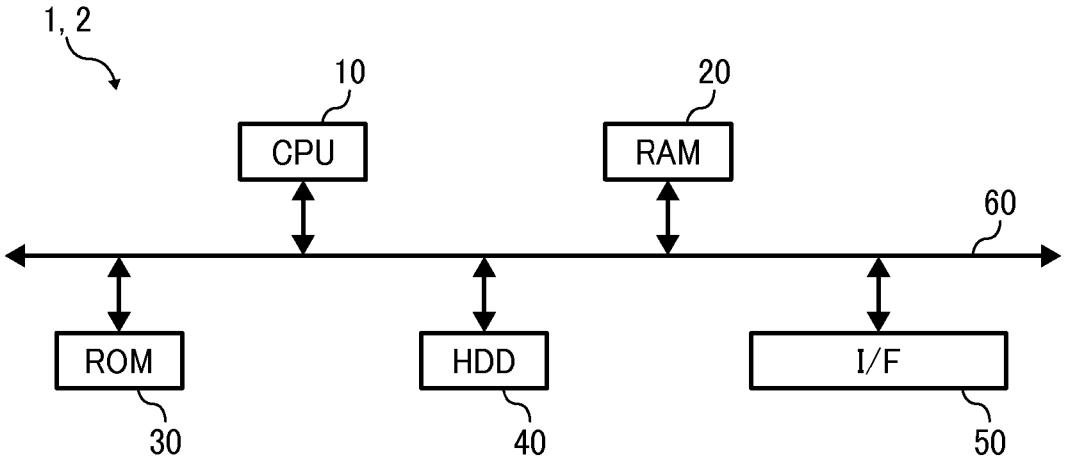
FIG. 2 is a block diagram illustrating the configuration of an information processing device, according to an example embodiment of the present invention.

FIG. 2 is a block diagram illustrating a hardware configuration that implements the information processing capability, according to an example embodiment of the present invention. The hardware configuration of the main controller 1 is illustrated in FIG. 2, but a similar hardware configuration applies to that of the engine controller 2 and the engine 3.

As illustrated in FIG. 2, the main controller 1 according to the present example embodiment has a configuration similar to that of ordinary information processing devices such as PCs (personal computers) and servers. In other words, a CPU (central processing unit) 10, a RAM (random access memory) 20, a ROM (read only memory) 30, a HDD (hard disk drive) 40, and an I/F (interface) 50 are connected to each other via a bus 60 in the main controller 1 according to the example embodiment of the present invention.

The CPU 10 serves as a computation unit, and controls the entire operation of the main controller 1. The RAM 20 is a volatile storage medium capable of reading and writing data at high speed, and is used as a working area when the CPU 10 processes data. The ROM 30 is a read-only nonvolatile storage medium in which firmware programs or the like are stored. The volatile HDD 40 is a data readable/writable nonvolatile storage medium in which an OS (operating system), various kinds of control programs, applications, programs, or the like are stored. The I/F 50 connects various kinds of hardware, networks, or the like to the bus 60, and controls these elements.

In such a hardware configuration, programs stored on the ROM 30, the HDD 40, or in another recording medium such as an optical disk are read by the RAM 20, and the CPU 10 performs computation according to these programs. This series of processes configures a software controller. The combination of the software controller as configured above and hardware configures a functional block that implements the capabilities of information processing, such as that of the main controller 1 according to the example embodiment of the present invention.

Next, the mechanical configuration of a part of the engine 3 and the conveyance of paper through the apparatus along a conveyance path will be described with reference to FIG. 3.

Figure 3:
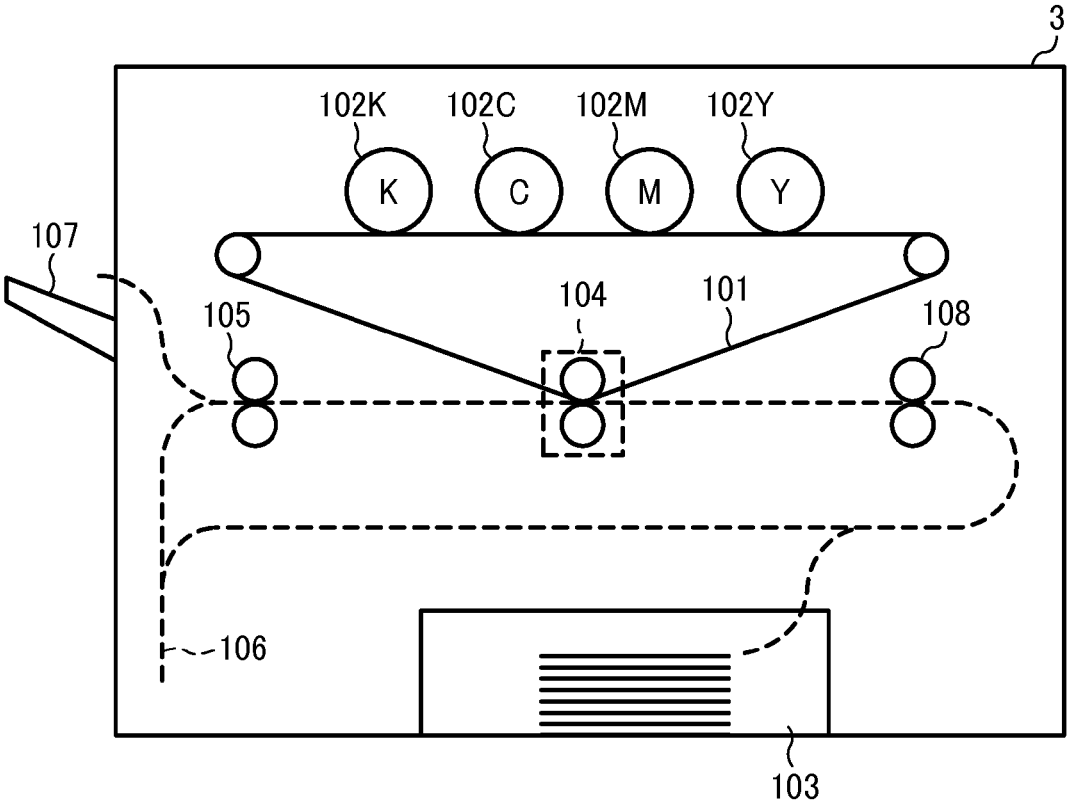
FIG. 3 illustrates the structure of an engine according to an example embodiment of the present invention.

As illustrated in FIG. 3, the engine 3 according to the example embodiment of the present invention has a structure in which photoreceptor drums 102Y, 102M, 102C, and 102K corresponding to four colors (they will be referred to simply as the photoreceptor drums 102) are arranged along a conveyance belt 101, which is a seamless moving body. Such a type of photoreceptor drums is called photoreceptor drums of tandem type. In other words, a plurality of photoreceptor drums 102Y, 102M, 102C, and 102K are arranged along the conveyance belt 101, which is an intermediate transfer belt on which an intermediate transfer image to be transferred to paper (i.e., an example of recording medium) fed from a paper feed tray 103 is formed, in the order listed from the upstream side of the conveyance direction of the conveyance belt 101.

The color images of toner that are respectively formed on the surfaces of the photoreceptor drums 102 of four colors are transferred to the conveyance belt 101, such that the color images are superimposed one above the other to form a full color image on the conveyance belt 101. The full color image formed on the conveyance belt 101 as above is transferred by a transfer unit 104 to paper that has been conveyed along the path, at a position where the conveyance path of paper illustrated as broken lines in FIG. 3 gets closest to the conveyance belt 101.

The paper on which the full color image has been formed is further conveyed, and the image is fixed at a fixing unit including a fixing roller 105. Then, the paper is ejected to a paper output tray 107. In the case of duplex printing, the paper on a side of which the full image has been formed and fixed is conveyed to a reverse path 106 to be reversed, and is conveyed toward the transfer unit 104 again to receive another image on the other side of paper. The paper fed from the paper feed tray 103 is conveyed by a paper transfer unit such as a conveyance roller 108 to the transfer unit 104.

In such an image forming apparatus, the transfer unit 104 includes a pair of vertically-arranged rollers that sandwich the conveyance belt 101 to form a nip, and further transfers the toner image from the conveyance belt 101 to conveyed paper at the nip. Moreover, the rollers of the transfer unit 104 according to the example embodiment of the present invention serve as a contacting and separating mechanism 104A that is controlled to create a gap between the pair of rollers. The contacting and separating mechanism 104A is used to cancel a shock jitter in which the conveyance speed of paper changes momentarily due to a change in friction force caused by varying thickness of paper, or to let an adjustment pattern, which is formed on the conveyance belt 101 for correcting an operational parameter of the image forming apparatus, pass the transfer unit 104.

Next, the contacting and separating mechanism 104A according to an example embodiment of the present invention is described.

Figure 4:
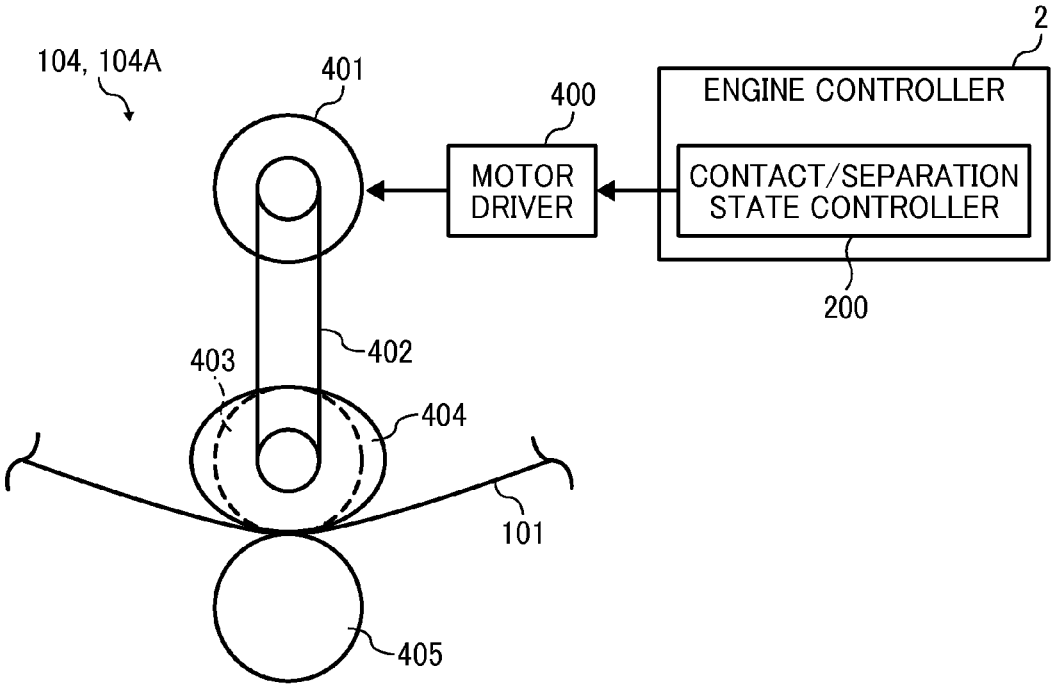
FIG. 4 illustrates a transfer unit and related control structure according to an example embodiment of the present invention.

FIG. 4 is a side view of the multiple rollers provided for the transfer unit 104, and illustrates a configuration to control the contacting and separating mechanism 104A of the transfer unit 104. As illustrated in FIG. 4, a transfer roller 403 gives tension to the conveyance belt 101, and presses the conveyance belt 101 against a counter roller 405.

Cams 404 are provided at both ends of the transfer roller 403, where the cams 404 are some distance away from the conveyance belt 101 and do not contact the conveyance belt 101. At a certain point during the rotation of the cams 404, the counter roller 405 moves away from the transfer roller 403 and the conveyance belt 101 and a gap is created therebetween. Note that the cam 404 is arranged at both ends of the transfer roller 403 and thus cannot be seen in actuality. However, the outline of the transfer roller 403 is shown by broken lines in FIG. 4 for clarifying the positional relationship.

A timing belt 402 is entrained around the cams 404 and the motor 401. Thus, the driving power generated by the rotation of the motor 401 is conveyed to the cams 404 such that the cams 404 rotate. The motor 401 is driven by a motor driver 400 to rotate. The motor driver 400 is controlled by a contact/separation state controller 200 provided for the engine controller 2.

Figure 5A:
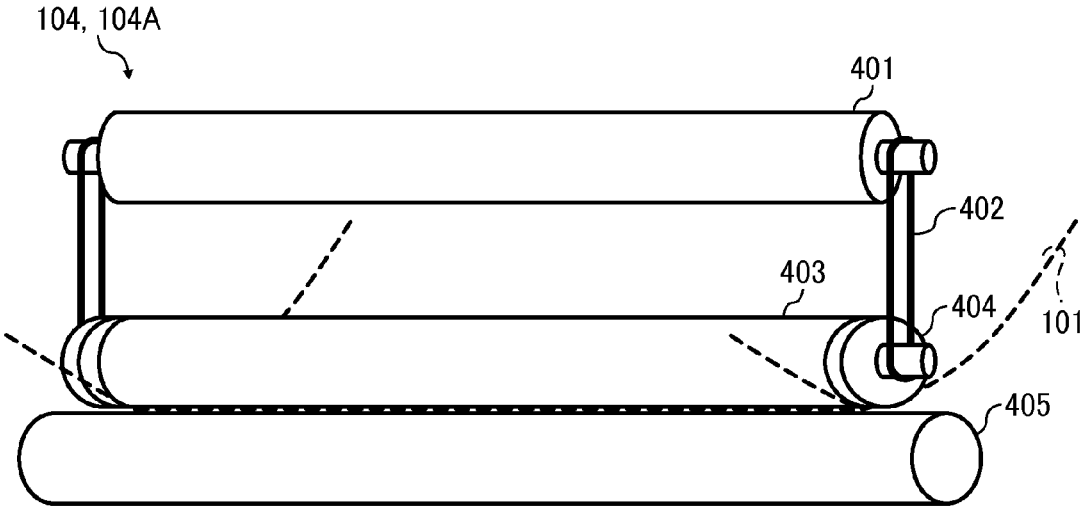
FIGS. 5A and 5B illustrate the contacting and separating mechanism of a transfer unit according to an example embodiment of the present invention.
Figure 5B:
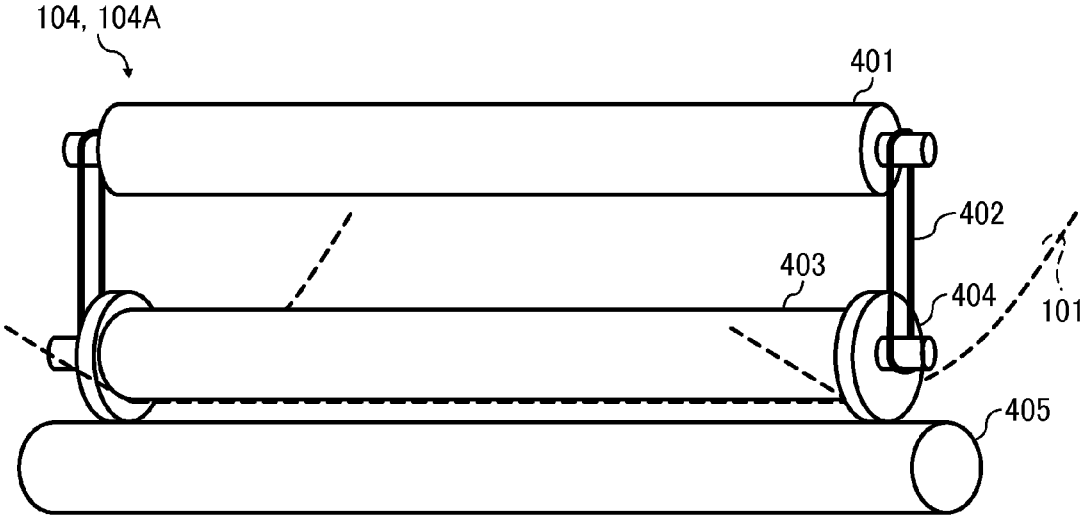

FIGS. 5A and 5B illustrate how the counter roller 405 moves away from the conveyance belt 101 and the transfer roller 403 due to the rotation of the cam 404.

FIG. 5A illustrates a state in which the counter roller 405 is pressed against the conveyance belt 101. In this state, the portions of the cam 404 where the diameter is narrow face the counter roller 405. By contrast, FIG. 5B illustrates a state in which the counter roller 405 is separated from the conveyance belt 101 and the transfer roller 403. In this state, the portions of the cam 404 where the diameter is wide face the counter roller 405, and the counter roller 405 is forced away from the conveyance belt 101 and the transfer roller 403 by the cam 404. Note that the counter roller 405 is pressed against the conveyance belt 101 by an elastic body such as a spring. Accordingly, as the cam 404 continues to rotate and returns to the state of FIG. 5A from the state of FIG. 5B, the state of the counter roller 405 also returns to the state of FIG. 5A.

The contacting and separating mechanism 104A illustrated in FIGS. 5A and 5B is mainly used to cancel shock jitter or to let an adjustment pattern, which is formed on the conveyance belt 101 for correcting an operational parameter of the image forming apparatus, pass the transfer unit 104. This contacting and separating mechanism 104A may be used when the image forming apparatus runs out of paper or there is a failure in paper conveyance due to paper jam.

Next, the functional configuration of the contact/separation state controller 200 of FIG. 4 is described below with reference to FIG. 6.

Figure 6:
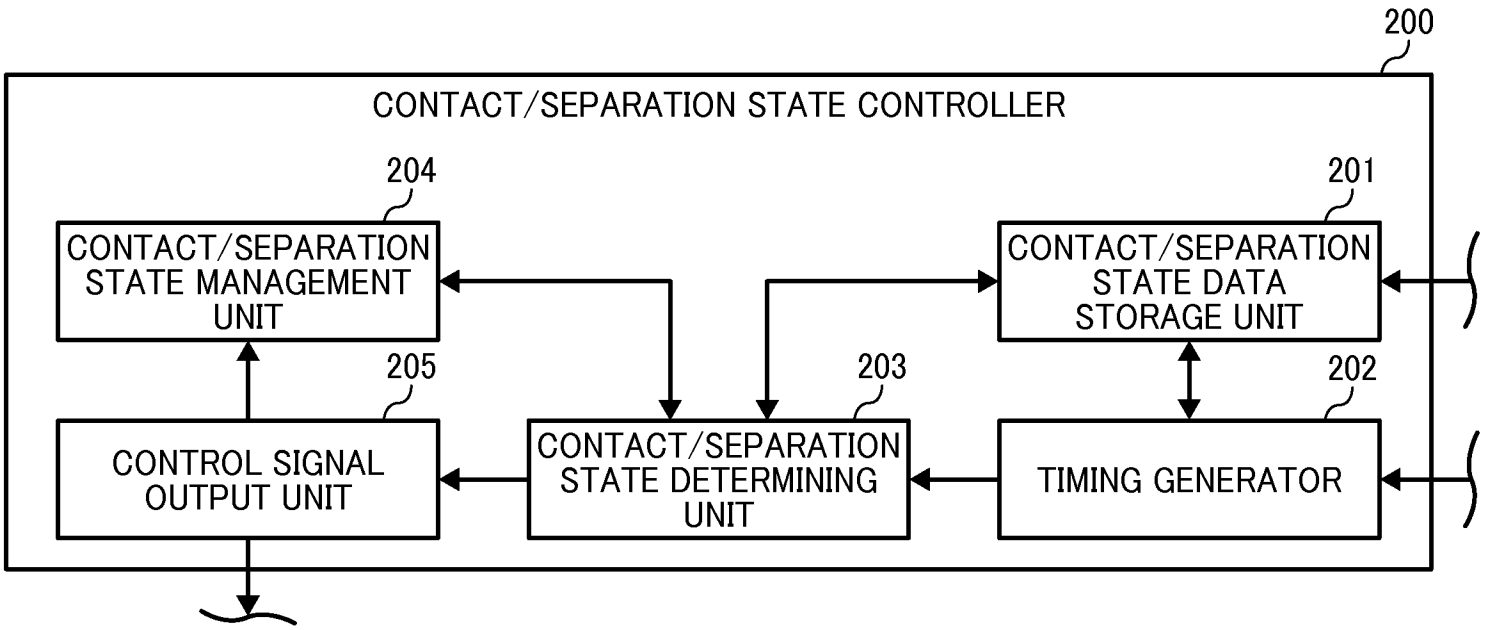
FIG. 6 is a block diagram illustrating the functional configuration of a contact/separation state controller according to an example embodiment of the present invention.

As illustrated in FIG. 6, the contact/separation state controller 200 according to the present example embodiment includes a contact/separation state data storage unit 201, a timing generator 202, a contact/separation state determining unit 203, a contact/separation state management unit 204, and a control signal output unit 205. As described above, the functional block as illustrated in FIG. 6 is achieved by the processing performed by the CPU 10 in accordance with the program loaded on the RAM 20 or the program stored on the ROM 30. When a program is executed, the CPU 10 loads the program from the ROM 30 or the HDD 40 onto the RAM 20 to perform operations according to the program. The program may be previously stored in any desired memory such as the ROM 30 or the HDD 40, or downloaded onto any desired memory from a network.

The contact/separation state data storage unit 201 obtains and stores data used for controlling the contacting and separating mechanism 104A of the transfer unit 104, for every page conveyed to the transfer unit 104, i.e., for every page on which an image is formed and is output. Moreover, the contact/separation state data storage unit 201 obtains and stores the data of the toner images that are formed on the conveyance belt 101 and are to be passed through the transfer unit 104, as is described in detail later.

The timing generator 202 obtains from the main controller 1 a trigger signal that indicates triggering timing used for determining the leading end and trailing end of paper from another device, for every page conveyed to the transfer unit 104; i.e., for every page on which an image is formed and is output. Then, the timing generator 202 determines the timing at which each of the leading end and trailing end of the paper passes through the transfer unit 104 in accordance with the data stored in the contact/separation state data storage unit 201. In other words, the timing generator 202 serves as a trigger signal obtaining unit that obtains a trigger signal used for determining the timing at which a toner image reaches the transfer unit 104. Note that the toner image is a developer image on which an image to be output is developed by developer.

The contact/separation state determining unit 203 determines whether it is necessary for the contacting and separating mechanism 104A to operate according to the data stored in the contact/separation state data storage unit 201 and the contact/separation state management unit 204, for every timing determined by the timing generator 202 at which the leading end and trailing end of paper reaches the transfer unit 104. In other words, the contact/separation state determining unit 203 serves as a conveyance error detector that compares an image ID for identifying a toner image reaching the transfer unit 104 with a stored passing image ID to detect an error in the conveyance of paper on which a toner image reaching the transfer unit 104 is to be transferred.

The contact/separation state management unit 204 stores a current contact/separation state at the transfer unit 104 in real time. The control signal output unit 205 outputs a control signal for controlling the motor driver 400 in accordance with the contact/separation state determining unit 203. In other words, the control signal output unit 205 of the contact/separation state controller 200 controls the contacting and separating mechanism 104A of the transfer unit 104 when an error is detected in the conveyance of paper on which a toner image reaching the transfer unit 104 is to be transferred.

According to the configuration as described above, even when the image forming apparatus runs out of paper or there is a failure in paper conveyance due to paper jam or the like and the image formed on the conveyance belt 101 enters the transfer unit 104 to which no paper has been conveyed, the counter roller 405 can be prevented from being soiled by toner.

Figures 7, 8:
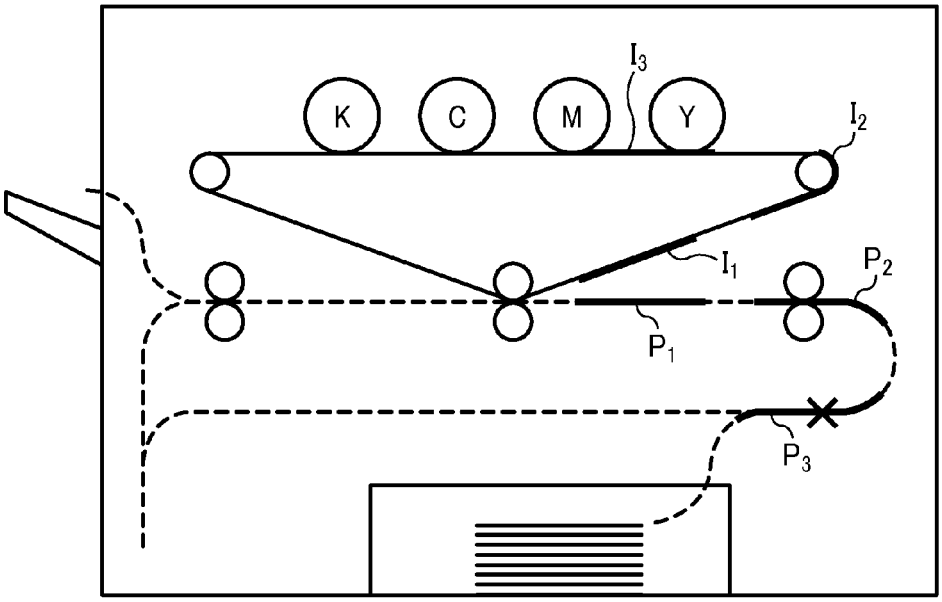
FIG. 7 illustrates how a failure occurs according to an example embodiment of the present invention.
FIG. 8 illustrates an example of contact/separation state data according to an example embodiment of the present invention.

FIG. 7 illustrates how such a failure occurs according to an embodiment of the present invention. In FIG. 7, toner images $I_1$, $I_2$, and $I_3$ are formed and being conveyed on the conveyance belt 101. At the same time, pieces of paper $P_1$, $P_2$, and $P_3$ that correspond to toner images $I_1$, $I_2$, and $I_3$, respectively, are also being conveyed from the paper feed tray 103.

FIG. 7 illustrates a case in which piece of paper $P_3$ is fed from the paper feed tray 103 and then is jammed at some point of the conveyance path. In this case, toner images $I_1$ and $I_2$ are transferred to corresponding pieces of paper $P_1$ and $P_2$, respectively, at the transfer unit 104. However, toner image $I_3$ enters the transfer unit 104 to which no paper has been conveyed because the corresponding piece of paper $P_3$ is jammed at some point of the conveyance path. Thus, it is desired that the toner of toner image $I_3$ be prevented from soiling the counter roller 405.

FIG. 8 illustrates an example of contact/separation state data according to an example embodiment of the present invention. More specifically, FIG. 8 depicts contact/separation state control data used for controlling the contacting and separating mechanism 104A of the transfer unit 104. The contact/separation state control data is obtained from the main controller 1 for every page on which an image is formed and is output, and is stored in the contact/separation state data storage unit 201. As depicted in FIG. 8, the contact/separation state control data according to an example embodiment of the present invention includes image ID, whether there is an adjustment pattern, whether shock jitter cancellation is needed, leading end timing, and trailing end timing.

The image ID is information identifying each page on which an image is formed and is output. The adjustment pattern is data indicating presence and absence, i.e., data indicating whether any pattern for adjusting operational parameters of the image forming apparatus is formed or not between a page identified by each image ID and the following page. In other words, the adjustment pattern is used as adjustment image data that indicates whether or not a pattern of images for adjusting the image forming apparatus is formed between images to be successively formed and output.

The shock jitter cancellation is data indicating whether or not shock jitter cancellation is necessary for preventing a change in conveyance speed due to the thickness of paper to be conveyed. In other words, the shock jitter cancellation is used as thickness-related information indicating whether or not a gap is to be created between the counter roller 405 and the conveyance belt 101 depending on the thickness of paper that serves as a recording medium.

The leading end timing and trailing end timing are data indicating time in seconds, for example, "xxx seconds". The leading end timing and trailing end timing are used to determine the timing at which the leading end and trailing end of paper reach the transfer unit 104 according to the trigger signal that the timing generator 202 obtains from the main controller 1.

Note that a storage medium for storing contact/separation state control data is allocated in the RAM 20 of FIG. 2 as a storage area for storing a specified number of image IDs, and the related adjustment patterns, shock jitter cancellation, leading end timing, and trailing end timing. Accordingly, data that has been referred to by the contact/separation state controller 200 and is no longer needed is successively overwritten so that the contact/separation state control data in the contact/separation state controller 200 is constantly updated. In other words, the contact/separation state data storage unit 201 serves as an image identifier obtaining unit that obtains and stores image IDs in the order of output as image identifiers that identify images to be output.

Figures 9, 10:
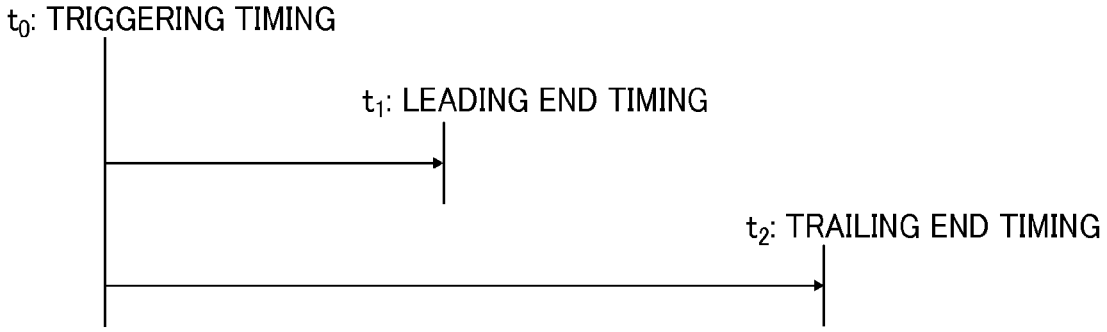
FIG. 9 illustrates an example of contact/separation state data according to an example embodiment of the present invention.
FIG. 10 illustrates an example of triggering timing according to an example embodiment of the present invention.

FIG. 9 illustrates an example of contact/separation state data according to an example embodiment of the present invention. More specifically, FIG. 9 illustrates an example of toner image data, which is stored in the contact/separation state data storage unit 201, that is formed on the conveyance belt 101 and is to be passed through the transfer unit 104 (hereinafter, such data is referred to as "image-to-be-passed data"). As illustrated in FIG. 9, passing image ID is used as image-to-be-passed data. Note that the passing image ID is data that corresponds to the image ID described with reference to FIG. 8. In other words, image-to-be-passed data indicates a toner image to be passed through the transfer unit 104 by referring to the identification information that corresponds to the image ID used as a part of contact/separation state control data. In other words, the contact/separation state data storage unit 201 also serves as a passing image identifier obtaining unit that obtains and stores passing image ID as a passing image identifier for identifying an image to be output to paper as a recording medium to which failure has occurred among the images to be formed and output.

The feeding and conveyance of paper from the paper feed tray 103 is controlled by the engine controller 2. Accordingly, when a paper jam occurs as illustrated in FIG. 7 or when the image forming apparatus runs out of paper, the engine controller 2 obtains the image ID of an image corresponding to paper that was not normally conveyed as passing image ID, and inputs the obtained image ID to the contact/separation state data storage unit 201. By so doing, image-to-be-passed data is stored in the contact/separation state data storage unit 201 as illustrated in FIG. 9.

For example, one or more sensors may be provided in the conveyance path to detect the time at which the leading end passes and the time at which the trailing end passes to output at least two sensor outputs. When the sensor outputs are not obtained, for example, during a predetermined time period, it is determined that the paper jam occurs.

FIG. 10 illustrates an example of triggering timing according to an example embodiment of the present invention. More specifically, FIG. 10 depicts how the timing generator 202 according to the example embodiment determines the timing at which the leading end and trailing end of paper reach the transfer unit 104 according to the trigger signal input from the main controller 1, and the data of leading end timing and trailing end timing described above with reference to FIG. 8.

As depicted in FIG. 10, the timing generator 202 starts measuring the time at timing t0 when the trigger signal is received, and measures the length of time in seconds that corresponds to the leading end timing depicted in FIG. 8 to create a signal that indicates the timing at which the leading end of paper reaches the transfer unit 104. In a similar manner, the timing generator 202 measures from timing t0 the length of time in seconds that corresponds to the trailing end timing depicted in FIG. 8 to create a signal that indicates the timing at which the trailing end of paper reaches the transfer unit 104.

Next, the operations of the contact/separation state controller 200 while the image forming apparatus according to the present example embodiment is performing a print job is described with reference to FIG. 11.

Figure 11:
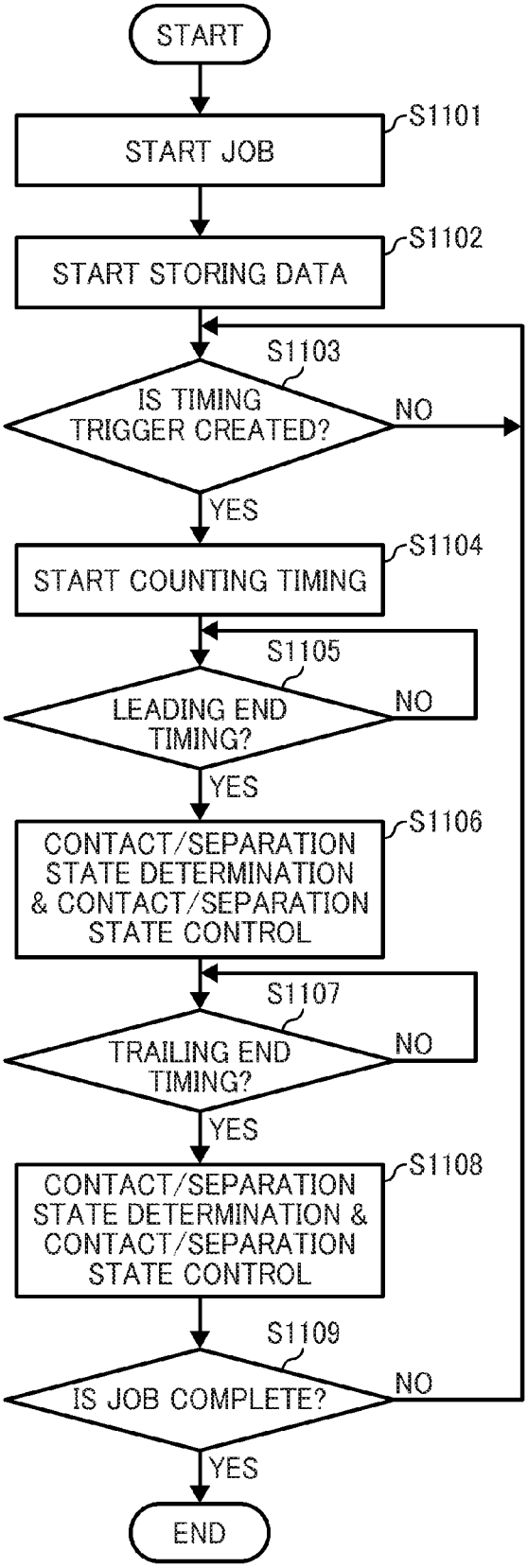
FIG. 11 is a flowchart illustrating contact/separation state controlling processes according to an example embodiment of the present invention.

FIG. 11 is a flowchart illustrating contact/separation state controlling processes according to an example embodiment of the present invention. As illustrated in FIG. 11, when the image forming apparatus starts performing a print job (S1101), the contact/separation state data storage unit 201 of the contact/separation state controller 200 starts storing the contact/separation state control data input from another device (S1102). Accordingly, the contact/separation state control data input from another device in the order of pages is stored on a storage medium, such as the RAM, as described above with reference to FIG. 8.

The contact/separation state control data input to the contact/separation state data storage unit 201 is input from the main controller 1 to the engine controller 2 when a print job is to be performed. After that, processing is repeated until the timing generator 202 receives a trigger signal, i.e., until a timing trigger is created, (S1103/NO). When a timing trigger is created (S1103/YES), the timing generator 202 refers to the leading end timing and trailing end timing, described above with reference to FIG. 8, in that order from the oldest, and starts counting the timing (S1104).

The timing generator 202 repeats counting the period of leading end timing until it has been counted up (S1105/NO), and when the period of leading end timing has been counted up (S1105/YES), the timing generator 202 inputs a timing signal to the contact/separation state determining unit 203 to indicate the timing at which the leading end of the paper reaches the transfer unit 104. Once a signal of the leading end timing end is received, the contact/separation state determining unit 203 refers to the contact/separation state control data stored in the contact/separation state data storage unit 201 in that order from the oldest, and also refers to the data of the contact/separation state management unit 204 to determine whether contact/separation state control of the transfer unit 104 is necessary and controls the contact/separation state as needed (S1106).

Subsequently, the timing generator 202 repeats counting the period of trailing end timing until it has been count up (S1107/NO), and when the period of trailing end timing has been count up (S1107/YES), the timing generator 202 inputs a timing signal to the contact/separation state determining unit 203 to indicate the timing at which the trailing end of the paper reaches the transfer unit 104.

Once a signal of the trailing end timing end is received, the contact/separation state determining unit 203 refers to the contact/separation state control data stored in the contact/separation state data storage unit 201 in that order from the oldest, and also refers to the data of the contact/separation state management unit 204 to determine whether contact/separation state control of the transfer unit 104 is necessary and control the contact/separation state when necessary (S1108). The contact/separation state controller 200 repeats the processes from S1103 to S1108 until the job is complete (S1109/NO), and terminates the process when the job is complete (S1109/YES). By performing such processes as described above, the contact/separation state controlling process for performing a print job according to the example embodiment becomes complete.

Next, the processes of S1106 and S1108 in FIG. 11 are described in detail.

Figure 12:
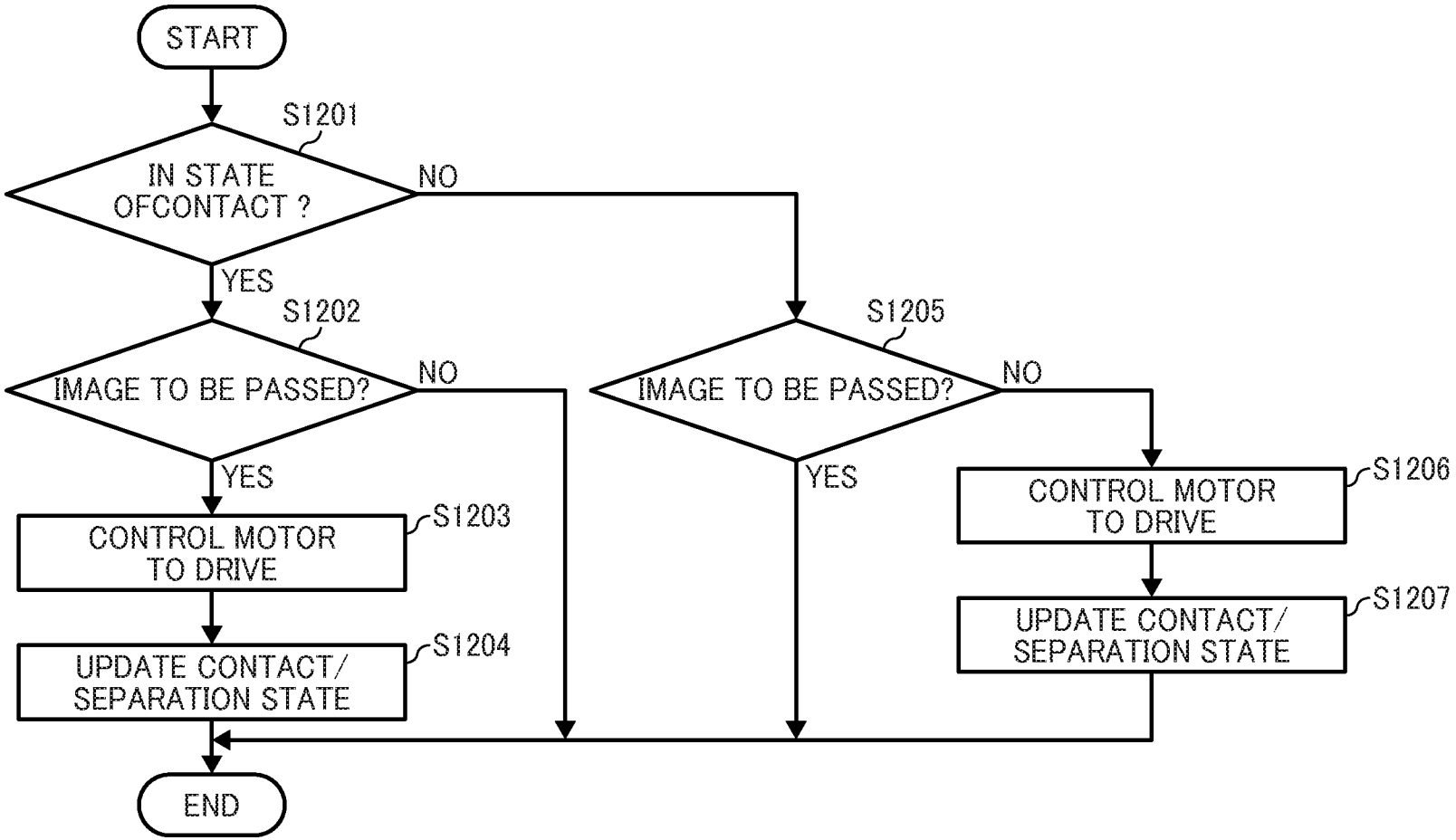
FIG. 12 is a flowchart illustrating contact/separation state determination processes of the leading end of paper, and contact/separation state controlling processes, according to an example embodiment of the present invention.

FIG. 12 is a flowchart illustrating the processes of S1106. As illustrated in FIG. 12, the contact/separation state determining unit 203 firstly refers to the data of the contact/separation state management unit 204 to determine whether or not the transfer unit 104 is currently in a state of contact, i.e., whether the transfer unit 104 is in the state of FIG. 5A or that of FIG. 5B (S1201). For example, data indicating the state of contact is stored in the contact/separation state management unit 204, and constantly updated as the state of contact changes.

When the transfer unit 104 is found to be in a state of contact as a result of the determination in S1201 (S1201/YES), the contact/separation state determining unit 203 determines whether or not the next image reaching the transfer unit 104 is an image to be passed (S1202). In S1202, the contact/separation state determining unit 203 determines whether or not any image ID of the undetermined data of the contact/separation state control data stored in the contact/separation state data storage unit 201 as depicted in FIG. 8 has been registered as "passing image ID", as in the passing image data of FIG. 9.

When the next image is found to be an image to be passed as a result of the determination of S1202 (S1202/YES), a gap is created between the counter roller 405 and the conveyance belt 101. Here, the result of determination in S1201 indicates a state of contact, and thus the contact/separation state determining unit 203 instructs the control signal output unit 205 to output a control signal for controlling the motor driver 400 to drive the motor 401 (S1203).

Accordingly, the motor 401 rotates by a specified angle to change the state of the transfer unit 104 from that of FIG. 5A to that of FIG. 5B, and the counter roller 405 moves away from the conveyance belt 101. The contact/separation state determining unit 203 updates the data of the contact/separation state management unit 204 from a state of contact to a state of separation (S1204), and then terminates the process.

If the next image is found to be not an image to be passed as a result of the determination of S1202 (S1202/NO), the contact/separation state determining unit 203 terminates the process immediately.

When the transfer unit 104 is found to be in a state of separation as a result of the determination in S1201 (S1201/NO), the contact/separation state determining unit 203 determines whether or not the next image reaching the transfer unit 104 is an image to be passed (S1205). When the next image is found to be an image to be passed as a result of the determination of S1205 (S1205/YES), a gap is to be created between the counter roller 405 and the conveyance belt 101. Here, the result of the determination performed in S1201 indicates a state of separation, and thus it is not necessary to drive the motor 401 to rotate and the contact/separation state determining unit 203 terminates the process immediately.

On the other hand, when the next image is not an image to be passed as a result of the determination of S1205 (S1205/NO), it is necessary for the counter roller 405 to contact the conveyance belt 101, such that a transferring process becomes possible. Here, the result of determination in S1201 indicates a state of separation, and thus the contact/separation state determining unit 203 instructs the control signal output unit 205 to output a control signal for controlling the motor driver 400 to drive the motor 401 (S1206).

Accordingly, the motor 401 rotates by a specified angle to change the state of the transfer unit 104 from that of FIG. 5B to that of FIG. 5A, and the counter roller 405 contacts the conveyance belt 101. The contact/separation state determining unit 203 updates the data of the contact/separation state management unit 204 from a state of separation to a state of contact (S1207), and then terminates the process.

By performing such processes as described above, the contact/separation state determination and contact/separation state controlling processes at the timing when the leading end of paper reaches the transfer unit 104 become complete.

Figure 13:
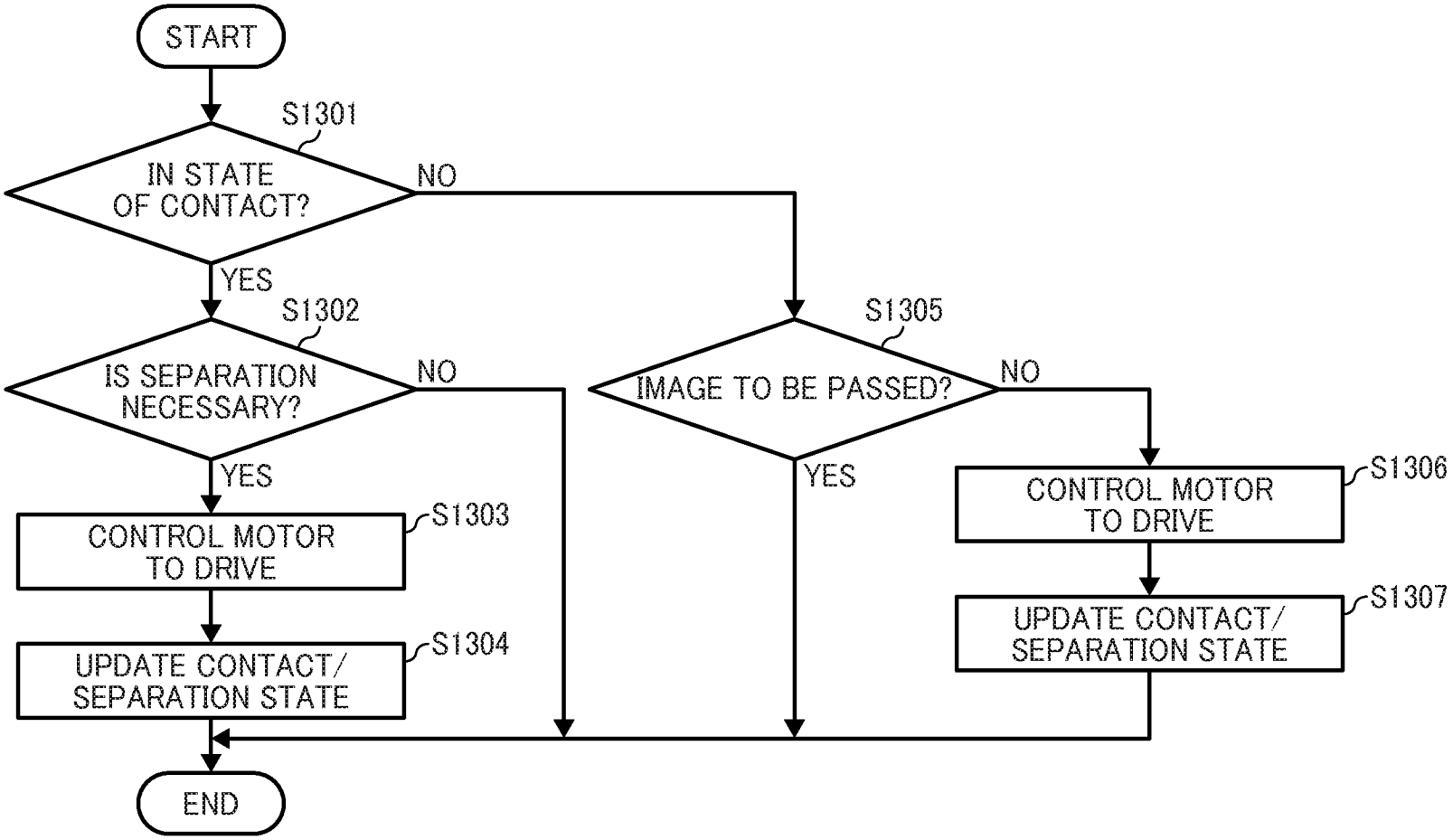
FIG. 13 is a flowchart illustrating contact/separation state determination processes of the trailing end of paper, and contact/separation state controlling processes, according to an example embodiment of the present invention.

FIG. 13 is a flowchart illustrating contact/separation state determination processes of the trailing end of paper, and contact/separation state controlling processes, according to an example embodiment of the present invention. More specifically, FIG. 13 is a flowchart illustrating the processes performed in S1108. As illustrated in FIG. 13, the contact/separation state determining unit 203 firstly refers to the data of the contact/separation state management unit 204 to determine whether or not the transfer unit 104 is currently in a state of contact, i.e., whether the transfer unit 104 is in the state of FIG. 5A or that of FIG. 5B (S1301). When the transfer unit 104 is determined to be in a state of contact as a result of the determination in S1301 (S1301/YES), the contact/separation state determining unit 203 determines whether or not it is necessary to make the transfer unit 104 be in a state of separation between the page that has just passed the transfer unit 104 and the next page reaching the transfer unit 104 (S1302).

In S1302, the contact/separation state determining unit 203 refers to the data of correction patterns in regard to the current page, and determines that separation is necessary between the current page and the next page when such correction patterns are present. Moreover, the contact/separation state determining unit 203 refers to the data of shock jitter cancellation in regard to the next page, and determines that separation is necessary between the current page and the next page when shock jitter cancellation is necessary.

When it is determined that separation is necessary as a result of the determination of S1302 (S1302/YES), the result of determination in S1301 indicates a state of contact, and thus the contact/separation state determining unit 203 instructs the control signal output unit 205 to output a control signal for controlling the motor driver 400 to drive the motor 401 (S1303). Accordingly, the motor 401 rotates by a specified angle to change the state of the transfer unit 104 from that of FIG. 5A to that of FIG. 5B, and the counter roller 405 moves away from the conveyance belt 101. The contact/separation state determining unit 203 updates the data of the contact/separation state management unit 204 from a state of contact to a state of separation (S1304), and then terminates the process.

On the other hand, when separation is not necessary as a result of the determination of S1302 (S1302/NO), the contact/separation state determining unit 203 terminates the process immediately.

When the transfer unit 104 is determines to be in a state of separation as a result of the determination in S1301 (S1301/NO), the contact/separation state determining unit 203 also determines whether or not it is necessary to make the transfer unit 104 be in a state of separation between the page that has just passed the transfer unit 104 and the next page reaching the transfer unit 104 (S1305). When separation is determined to be necessary as a result of the determination in S1305 (S1305/YES), the result of determination in S1301 indicates a state of separation, and thus it is not necessary to drive the motor 401 to rotate and the contact/separation state determining unit 203 terminates the process immediately.

On the other hand, when separation is determined to be not necessary as a result of the determination of S1305 (S1305/NO), it is necessary for the counter roller 405 to contact the conveyance belt 101, such that a transferring process becomes possible. Here, the result of determination in S1301 indicates a state of separation, and thus the contact/separation state determining unit 203 instructs the control signal output unit 205 to output a control signal for controlling the motor driver 400 to drive the motor 401 (S1306).

Accordingly, the motor 401 rotates by a specified angle to change the state of the transfer unit 104 from that of FIG. 5B to that of FIG. 5A, and the counter roller 405 contacts the conveyance belt 101. The contact/separation state determining unit 203 updates the data of the contact/separation state management unit 204 from a state of separation to a state of contact (S1307), and then terminates the process.

By performing such processes as described above, the contact/separation state determination and contact/separation state controlling processes at the timing when the trailing end of paper reaches the transfer unit 104 become complete.

As described above, when there is a failure in the conveyance of paper in the image forming apparatus according to an example embodiment of the present invention, an identifier that identifies the image to be transferred on the paper is used to determine the timing at which the toner image of the developed image passes through the transfer unit 104, and the contacting and separating mechanism 104A of the transfer unit 104 is driven to cancel shock jitter or avoid a pattern for adjusting. Accordingly, a member disposed opposite a holding member that holds the developed image may be prevented from being soiled by developer.

Moreover, a contacting and separating mechanism 104A of the transfer unit 104 is used to avoid shock jitter cancellation or an adjustment pattern, according to the example embodiment of the present invention. Accordingly, it is not necessary to provide a dedicated mechanism for an image forming apparatus, and such an image forming apparatus can be produced at low cost.

Conventionally, when a failure occurs in paper conveyance, an already-formed image soils the counter roller 405. Thus, a separate toner removing mechanism is provided in order to remove the soil. By contrast, an image forming apparatus according to an example embodiment of the present invention is able to omit a toner removing mechanism because a contacting and separating mechanism 104A of the transfer unit 104 prevents the counter roller 405 from being soiled by toner. Accordingly, the cost of manufacturing image forming apparatuses can be reduced.

In the embodiments above, a case of a two-step transfer image forming apparatus with the conveyance belt 101 has been described as an example. When a two-step transfer system is adopted, there are some cases in which adjustment patterns as described above are formed on the conveyance belt 101 in addition to the toner images to be transferred to paper, and a toner removing mechanism is usually provided to remove residual toner images from the conveyance belt 101.

Accordingly, even when an error occurs in conveyance of paper, an erroneous toner image can be removed as long as such an erroneous toner image passes through the transfer unit 104. This is because the surface of the conveyance belt 101 is cleaned by a generally-provided toner removing mechanism. For this reason, an erroneous toner image due to an error occurred in conveyance of pager can be dealt with without making a major change to the configuration of an apparatus, according to an example embodiment of the present invention.

In the above embodiments, a case of a contacting and separating mechanism 104A as illustrated in FIG. 4 and FIGS. 5A and 5B has been described as an example, but no limitation is indicated therein. In other words, other various kinds of mechanisms may be adopted as long as the engine controller 2 creates a gap between the conveyance belt 101 that serves as a holding member and holds a toner image and the counter roller 405 that serves as a pressing member and is disposed opposite the surface of the conveyance belt 101 on which a toner is kept to press paper against the transfer roller 101 and the transfer roller 403.

In the above embodiments, force is applied to the counter roller 405 such that the counter roller 405 is pressed against the conveyance belt 101 and the transfer roller 403, and the cam 404 presses the counter roller 405 downwards to create a gap. By contrast, for example, a configuration in which the counter roller 405 is fixed and the secondary transfer roller 403 is pressed against the counter roller 405 over the conveyance belt 101 is also possible.

In such a case, a gap is created between the conveyance belt 101 and the counter roller 405 by loosening the pressing force on the secondary transfer roller 403. However, the conveyance belt 101 needs to be elastic in such a configuration. Moreover, as the conveyance belt 101 expands and contracts, the shape of the toner image formed on the surface of the conveyance belt 101 changes. By contrast, the tension applied to the conveyance belt 101 is constant in the configuration illustrated in FIG. 4 and FIGS. 5A and 5B, and no such problem occurs.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

Further, as described above, any one of the above-described and other methods of the present invention may be embodied in the form of a computer program stored on any kind of storage medium. Examples of storage media include, but are not limited to, flexible disk, hard disk, optical discs, magneto-optical discs, magnetic tapes, nonvolatile memory cards, ROM (read-only-memory), etc. Alternatively, any one of the above-described and other methods of the present invention may be implemented by ASICs, prepared by interconnecting an appropriate network of conventional component circuits, or by a combination thereof with one or more conventional general-purpose microprocessors and/or signal processors programmed accordingly.

What is claimed is:

1. An image forming apparatus comprising:

a photoreceptive drum configured to transfer images to a rotating belt;

a transfer unit configured to receive recording sheets that correspond and align with images on the belt, wherein the transfer unit includes:

a transfer roller configured to contact and rotate with the belt;

a counter roller configured to contact and convey the recording sheets; and a mechanism configured to close a gap between the transfer roller and the counter roller to cause the images on the belt to form on the recording sheets, and to open the gap between the transfer roller and the counter roller to cause the belt and the counter roller to separate;

a timing unit configured to estimate a time delay for the recording sheets to reach the transfer unit;

an image identifier obtaining unit configured to obtain and store image identifiers for identifying a plurality of images to be formed;

a passing image identifier obtaining unit configured to obtain and store a passing image identifier for identifying only an image to be output to a recording sheet to which a conveyance error has occurred among images to be formed and output;

a conveyance error decision unit configured to compare an image identifier identifying one of the images subsequently reaching the transfer unit with a stored passing image identifier to detect the conveyance error of the recording sheet to which the image subsequently reaching the transfer unit is to be transferred; and a controller configured to, in a case that the conveyance error has occurred in the one or more of the recording sheets, direct the mechanism to maintain the transfer roller and the counter roller in a closed state for recording sheets that reach the transfer unit for which no conveyance error has been detected;

the controller configured, in a case that the conveyance error has occurred in the one or more of the recording sheets, to direct the mechanism to initiate maintaining the transfer roller and the counter roller in an opened state for the one or more recording sheets associated with the conveyance error, wherein a timing of the initiating of the opened state is based on the time delay for the one or more recording sheets associated with the conveyance error to reach the transfer unit.

2. The image forming apparatus according to claim 1 wherein:

the controller is configured to direct the mechanism to open the gap between the transfer roller and the counter roller based on a determination that a recording sheet which exceeds a prescribed thickness threshold is to be conveyed through the transfer unit.

3. The image forming apparatus according to claim 1 wherein:

the controller is configured to direct the mechanism to open the gap between the transfer roller and the counter roller based on a determination that an adjustment image formed on the rotating belt for adjusting the image forming apparatus is to be conveyed through the transfer unit.

4. The image forming apparatus according to claim 1 wherein the controller creates the gap between the transfer roller and the counter roller when the conveyance error decision unit decides that the conveyance error of one of the recording sheets to which the image subsequently reaching the transfer unit is to be transferred.

5. The image forming apparatus according to claim 1 wherein:

when a conveyance error occurs to one of the recording sheets and any of a plurality of developer images to be conveyed to the transfer unit becomes a developer image subsequently reaching the transfer unit, the conveyance error decision unit compares the image identifier for identifying the developer image with the stored passing image identifier.

6. The image forming apparatus according to claim 1 wherein:

the conveyance error decision unit decides whether or not a conveyance error is occurring to the recording sheet at a timing, calculated by the timing unit, when a leading end of the recording sheet reaches the transfer unit.

7. The image forming apparatus according to claim 1 further comprising:

a trigger signal obtaining unit configured to obtain a trigger signal used for determining timing at which the developer image on which an image to be output is developed by developer reaches the transfer unit that transfers the developer image to the recording sheet; and a timing storage unit configured to store, for each of the image identifiers, a length of time it takes since an obtainment timing when the trigger signal is obtained until a leading end timing when a leading end of the recording sheet reaches the transfer unit, wherein the timing unit estimates the time delay according to the obtainment timing when the trigger signal is obtained and the length of time it takes since the obtainment timing when the trigger signal is obtained and the leading end timing when a leading end of the recording sheet reaches the transfer unit.

8. The image forming apparatus according to claim 1 further comprising:

a contact/separation state management unit configured to store a contact/separation state of the transfer roller and the counter roller;

a driver configured to change the contact/separation state of the transfer roller and the counter roller; and a contact/separation controller configured to determine, according to the time delay, whether or not the contact/separation state stored in the contact/separation state management unit is in a contact state, and determine to drive the driver unit when the contact/separation state stored in the contact/separation state management unit is in the contact state and conveyance error is occurring to the recording sheet to which the developer image subsequently reaching the transfer unit is to be transferred or when the contact/separation state stored in the contact/separation state management unit is in a separation state and no conveyance error is occurring to the recording sheet to which the developer image subsequently reaching the transfer unit is to be transferred.

9. The image forming apparatus according to claim 8 wherein:

the contact/separation controller determines, according to the time delay, whether the contact/separation state stored in the contact/separation state management unit is in a contact state, and determines not to drive the driver unit when the contact/separation state stored in the contact/separation state management unit is in the separation state and a conveyance error is occurring to the recording sheet to which the developer image subsequently reaching the transfer unit is to be transferred or when the contact/separation state stored in the contact/separation state management unit is in the contact state and no conveyance error is occurring to the recording sheet to which the developer image subsequently reaching the transfer unit is to be transferred.

10. The image forming apparatus according to claim 2 further comprising:

a timing generator configured to calculate a trailing end timing at which a trailing end of the recording sheet reaches the transfer unit;

a contact/separation state management unit configured to store a contact/separation state of the transfer roller and the counter roller;

a driver unit configured to change a contact/separation state of the transfer roller and the counter roller; and a contact/separation controller configured to determine, according to the trailing end timing, whether the contact/separation state stored in the contact/separation state management unit is in a contact state, and determine to drive the driver unit when the contact/separation state stored in the contact/separation state management unit is in the contact state and a thickness of the recording sheet that subsequently reaches the transfer unit is equal to or greater than a prescribed thickness or when the contact/separation state stored in the contact/separation state management unit is in the separation state and the thickness of the recording sheet that subsequently reaches the transfer unit is thinner than the prescribed thickness.

11. The image forming apparatus according to claim 10 wherein:

the contact/separation controller determines, according to the trailing end timing, whether the contact/separation state stored in the contact/separation state management unit is in a contact state, and determines not to drive the driver unit when the contact/separation state stored in the contact/separation state management unit is in the separation state and the thickness of the recording sheet that subsequently reaches the transfer unit is greater than the prescribed thickness or when the contact/separation state stored in the contact/separation state management unit is in the contact state and the thickness of the recording sheet that subsequently reaches the transfer unit is thinner than the prescribed thickness.

12. The image forming apparatus according to claim 3 further comprising:

a timing generator configured to estimate a trailing end timing at which a trailing end of the recording sheet reaches the transfer unit;

a contact/separation state management unit configured to store a contact/separation state of the transfer roller and the counter roller;

a driver unit configured to change a contact/separation state of the transfer roller and the counter roller; and a contact/separation controller configured to determine, according to the trailing end timing, whether the contact/separation state stored in the contact/separation state management unit is in a contact state, and to drive the driver unit when the contact/separation state stored in the contact/separation state management unit is in the contact state and the adjustment image is present between a developer image subsequently reaching the transfer unit and the transfer unit or when the contact/separation state stored in the contact/separation state management unit is in the separation state and the adjustment image is not present between the developer image subsequently reaching the transfer unit and the transfer unit.

13. The image forming apparatus according to claim 12 wherein:

the contact/separation controller determines, according to the trailing end timing, whether the contact/separation state stored in the contact/separation state management unit is in a contact state, and to determines not to drive the driver unit when the contact/separation state stored in the contact/separation state management unit is in the separation state and the adjustment image is present between the developer image subsequently reaching the transfer unit and the transfer unit or when the contact/separation state stored in the contact/separation state management unit is in the contact state and the adjustment image is not present between the developer image subsequently reaching the transfer unit and the transfer unit.

14. A method of controlling an image forming apparatus, the method comprising:

transferring images from photoreceptive drums to a rotating belt;

receiving, at a transfer unit, recording sheets that correspond and align with images on the belt, wherein the transfer unit includes:

a transfer roller for contacting and rotating with the belt;

a counter roller for contacting and conveying the recording sheets; and a mechanism for closing a gap between the transfer roller and the counter roller to cause the images on the belt to form on the recording sheets, and for opening the gap between the transfer roller and the counter roller to cause the belt and the counter roller to separate;

estimating a time delay for the recording sheets to reach the transfer unit;

obtaining and storing image identifiers for identifying a plurality of images to be formed;

obtaining and storing a passing image identifier for identifying only an image to be output to a recording sheet to which a conveyance error has occurred among images to be formed and output;

comparing an image identifier identifying one of the images subsequently reaching the transfer unit with a stored passing image identifier to detect the conveyance error of the recording sheet to which the image subsequently reaching the transfer unit is to be transferred;

in a case of detecting the conveyance error of one or more of the recording sheets, directing the mechanism to maintain the transfer roller and the counter roller in a closed state for recording sheets that reach the transfer unit for which no conveyance error has been detected; and in a case of detecting the conveyance error of one or more of the recording sheets, directing the mechanism to initiate maintaining the transfer roller and the counter roller in an opened state for the one or more recording sheets associated with the conveyance error, wherein a timing of the initiation of the opened state is based on a time delay for the one or more recording sheets associated with the conveyance error to reach the transfer unit.

15. A computer-readable non-transitory recording medium storing a program for causing an information processing device to execute a method controlling an image forming apparatus, the method comprising:

transferring images from photoreceptive drums to a rotating belt;

receiving, at a transfer unit, recording sheets that correspond and align with images on the belt, wherein the transfer unit includes:

a transfer roller for contacting and rotating with the belt;

a counter roller for contacting and conveying the recording sheets; and a mechanism for closing a gap between the transfer roller and the counter roller to cause the images on the belt to form on the recording sheets, and for opening the gap between the transfer roller and the counter roller to cause the belt and the counter roller to separate;

estimating a time delay for the recording sheets to reach the transfer unit;

obtaining and storing image identifiers for identifying a plurality of images to be formed;

obtaining and storing a passing image identifier for identifying only an image to be output to a recording sheet to which a conveyance error has occurred among images to be formed and output;

comparing an image identifier identifying one of the images subsequently reaching the transfer unit with a stored passing image identifier to detect the conveyance error of the recording sheet to which the image subsequently reaching the transfer unit is to be transferred;

in a case of detecting the conveyance error of one or more of the recording sheets, directing the mechanism to maintain the transfer roller and the counter roller in a closed state for recording sheets that reach the transfer unit for which no conveyance error has been detected; and in a case of detecting the conveyance error of one or more of the recording sheets, directing the mechanism to initiate maintaining the transfer roller and the counter roller in an opened state for the one or more recording sheets associated with the conveyance error, wherein a timing of the initiation of the opened state is based on the time delay for the one or more recording sheets associated with the conveyance error to reach the transfer unit.

* * * * *